United States Patent [19]

Stegmüller

[11] Patent Number: 4,983,793

[45] Date of Patent: Jan. 8, 1991

[54] SWITCH CHAMBER FOR A VACUUM SWITCH

[75] Inventor: Karl Stegmüller, Wiesent, Fed. Rep. of Germany

[73] Assignee: Sachsenwerk Aktiengesellschaft, Regensburg, Fed. Rep. of Germany

[21] Appl. No.: 390,394

[22] Filed: Aug. 7, 1989

[30] Foreign Application Priority Data

Aug. 6, 1988 [DE] Fed. Rep. of Germany ..... 8810063

[51] Int. Cl.[5] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,082,307 | 3/1963 | Greenwood et al. | 200/144 B |
| 3,657,502 | 4/1972 | Cherry et al. | 200/144 B |
| 4,394,554 | 7/1983 | Warabi et al. | 200/144 B |
| 4,478,347 | 10/1984 | Cherry et al. | 200/144 B |

*Primary Examiner*—Robert S. Macon

*Attorney, Agent, or Firm*—Spencer & Frank

[57] ABSTRACT

A switch chamber for a vacuum switch including a housing having at least one insulating tube with an end face and an axial axis. A contact pin having an exterior surface is arranged for supporting the switch chamber. A stationary contact is held by the contact pin within the housing and has a frontal face. A movable contact contacts the frontal face of the stationary contact in the on-position of the vacuum switch under the force of a contact spring. A seal including a bellows connects the movable contact with the housing in a vacuum-tight manner. A terminating cover is connected to the insulating tube and to the contact pin in a vacuum-tight manner and transfers to the housing impact forces generated when the vacuum switch is switched on. The insulating tube comprises a ceramic tube. The terminating cover has a corrugated shape including at least one full corrugation and has an outer cut edge fastened to the end face of the ceramic tube and an inner cut edge fastened to the exterior surface of the contact pin.

14 Claims, 2 Drawing Sheets

SWITCH CHAMBER FOR A VACUUM SWITCH

CROSS REFERENCE TO RELATED APPLICATIONS

This application claims the priority of application Ser. No. G 88 10 063.4 filed Aug. 6th, 1988, in the Federal Republic of Germany, the subject matter of which is incorporated herein by reference.

BACKGROUND OF THE INVENTION

The present invention relates to a switch chamber for a vacuum switch of the type including a housing composed of at least one insulating tube and in which a contact pin mounts a stationary contact within the housing and is arranged for supporting the switch chamber. A movable contact contacts the frontal face of the stationary contact in the on-position of the vacuum switch under the force of a contact spring. A seal including a bellows connects the movable contact with the housing in a vacuum-tight manner. A terminating cover is connected to the insulating tube and to the contact pin in a vacuum-tight manner and transfers to the housing impact forces generated when the vacuum switch is switched on.

Such a switch chamber is disclosed in U.S. Pat. No. 3,082,307 in which FIG. 6 shows a curved, metal intermediate member or terminating cover which is disposed between the contact pin and an isolator. The distance between these latter two components is relatively small and the terminating cover overlaps the contact pin at the point of connection which comprises a rigid, clamped attachment. According to the illustration in the patent, the isolator is a glass tube into which the outer end of the terminating cover is melted. On the basis of its described features, the terminating cover must be considered to be relatively stiff. Such a switch chamber is not suitable for large numbers of high current switching operations.

SUMMARY OF THE INVENTION

It is an object of the present invention to improve the above described prior art switch chamber so that it is able to handle high currents with a high frequency of switching.

The above and other objects are accomplished in accordance with the invention by the provision of a switch chamber of the type first described above in which the insulating tube is a ceramic tube and the terminating cover has a corrugated shape and includes at least one full corrugation. The terminating cover also has an outer cut edge fastened to the end face of the ceramic tube and an inner cut edge fastened to the exterior surface of the contact pin.

The terminating cover according to the invention provides for substantial mechanical decoupling of the housing so that current loads on the stationary contact occurring primarily during turn-on are not transferred, or only to a minimum degree, to the components and connection points of the housing. Additionally, the selected configuration is insensitive to forces acting laterally to the axis of the switching chamber with high short-circuit currents in multi-phase networks.

BRIEF DESCRIPTION OF THE DRAWINGS

The advantages of the invention can be described with reference to the drawing figures, wherein.

DETAILED DESCRIPTION OF THE PREFERRED EMBODIMENT

Figure 1:
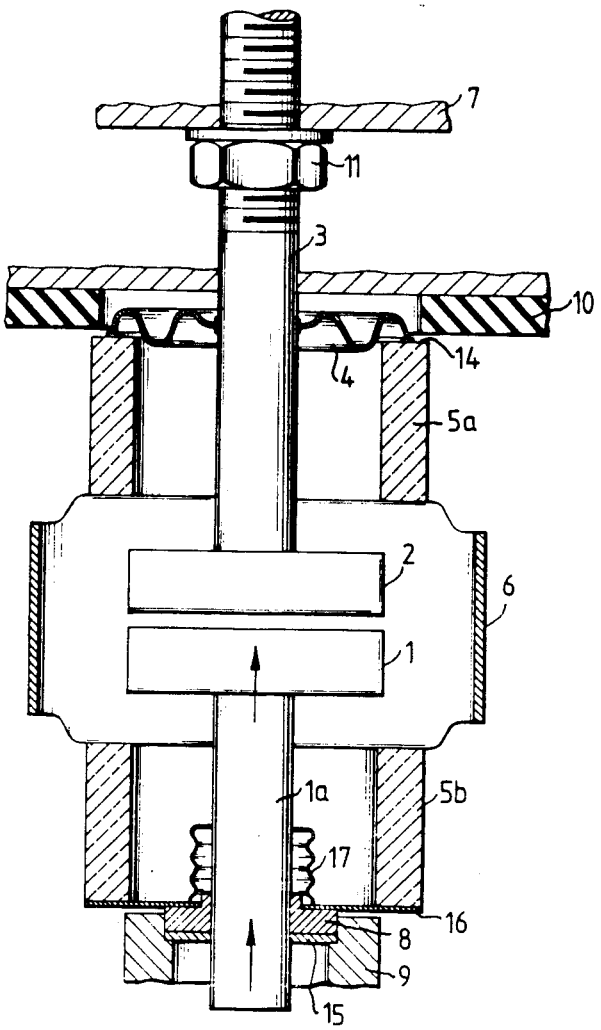
FIG. 1 is a sectional view of a switch chamber according to the invention.

Referring to FIG. 1, there is shown a switch chamber according to the invention which is composed of a movable contact 1 supported by a movable contact pin 1*a*, and a stationary contact 2 mounted on the end of a stationary contact pin 3 which is connected to a transverse member 7 by way of a screw connection 11. Contacts 1 and 2 are encased in a housing composed of two ceramic tubes 5*a*, 5*b* and a metal jacket tube 6 disposed therebetween. Ceramic tube 5*a* is connected with the stationary contact pin 3 by way of a terminating member or cover 4. Terminating cover 4 is preferably made of chromium-nickel steel (e.g. a stainless steel of 18% chromium and 9 percent nickel) having a wall thickness of no more than 1 mm. On the side of movable contact 1, the chamber is closed in a vacuum-tight manner by means of a closing cover 16 and a bellows 17. A guide sleeve 8 supports movable contact pin 1*a*. Guide sleeve 8 is supported in a fixed supporting body 9.

Figure 2:
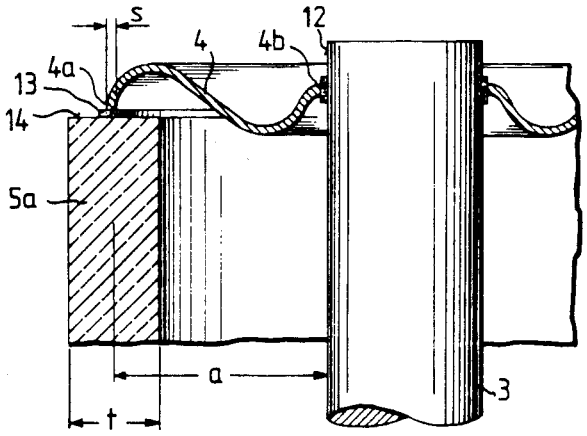
FIG. 2 is an enlarged, partial sectional view of another embodiment of the invention showing a modified terminating cover with respect to that of FIG. 1.

FIG. 2 shows an embodiment of terminating cover 4 in the form of a single corrugation. An outer end 4*a* of terminating cover 4 has a cut edge which is fastened at approximately a right angle to end face 14 of ceramic tube 5*a* while an inner end 4*b* of terminating cover 4 has a cut edge which is fastened at approximately right angle to exterior surface 12 of stationary contact pin 3. Terminating cover 4 may be fastened to ceramic tube 5*a* and contact pin 3 by means of solder connections or by welded connections.

FIG. 1 shows a multiple-corrugation terminating cover 4 which is suited particularly for switch chambers having large diameters. Nevertheless, the connecting points are subject to the same criteria as in FIG. 2.

It is of particular advantage if the length of the center line of terminating cover 4 is at least 1.5 times longer than the linear distance a between outer fastening point 13 and exterior face 12 of contact pin 3. Such a configuration also permits the absorption of lateral or twisting forces acting on stationary contact 2 without endangering the housing.

It is a particular advantage of the invention for terminating cover 4 not only to have a corrugated shape but also to be fastened with its respective cut end faces to frontal end face 14 of ceramic tube 5*a* and to exterior surface 12 of contact pin 3, respectively. With respect to the fastening location at ceramic tube 5*a*, shrinkage stresses caused because of the differences in coefficients of thermal expansion between the ceramic material and the material of the terminating cover can be kept within narrow limits. Such shrinkage stresses decrease with the ratio of the thickness s of terminating cover 4 to the thickness t of ceramic tube 5*a*. Moreover, the fastening of the frontal faces of the cut ends of terminating cover 4 imparts a certain flexibility to the latter. This flexibility makes the spring constant of terminating cover 4 lower than if it were fastened in a manner corresponding to a rigid, clamped connection. The fastening of terminating cover 4 according to the invention to contact pin 3 additionally limits displacement forces possible under asymmetrical loads and high short-circuit currents by rotating contact pin 3 relative to terminating cover 4.

In spite of its low spring constant, terminating cover 4 is an elastic component. In order to prevent the housing from swinging up and down due to slight shocks, it is advantageous to dispose a support ring 15 without a gap between guide sleeve 8 and fixed supporting body 9. Additionally, a damping buffer 10 is preferably arranged around stationary contact pin 3 against which the housing, preferably the outer edge of ceramic tube 5*a*, can abut in its elastic deflections. These buffers limit such elastic deformations and take care that the stresses connected therewith remain limited to low values.

Obviously, numerous and additional modifications and variations of the present invention are possible in light of the above teachings. It is therefore to be understood that within the scope of the appended claims, the invention may be practice otherwise than as specifically claimed.

What is claimed is:

1. In a switch chamber for a vacuum switch, including: a housing having at least one insulating tube with an end face and an axial axis; a contact pin having an exterior surface and arranged for supporting the switch chamber; a stationary contact held by the contact pin within the housing and having a frontal face; a movable contact contacting the frontal face of the stationary contact in the on-position of the vacuum switch under the force of a contact spring; sealing means including a bellows for connecting the movable contact with the housing in a vacuum-tight manner; a terminating cover connected to the insulating tube and to the contact pin in a vacuum-tight manner and transferring to the housing impact forces generated when the vacuum switch is switched on, the improvement wherein:

said insulating tube comprises a ceramic tube; and said terminating cover comprises chromium-nickel steel having a wall thickness of no more than 1 mm and has a corrugated shape including at least one full corrugation, said termination cover further having an outer cut edge fastened to the end face of said ceramic tube and an inner cut edge fastened to the exterior surface of said contact pin.

2. A switch chamber for a vacuum switch as defined in claim 1, wherein the outer edge and the inner edge of said terminating cover are arranged at approximately a right angle to the end face of said ceramic tube and the exterior surface of said contact pin, respectively.

3. A switch chamber for a vacuum switch as defined in claim 1, wherein said terminating cover has a center line which is at least 1.5 times longer than the distance between where the outer edge of said terminating cover is fastened to the end face of said ceramic tube and where the inner edge of said terminating cover is fastened to the exterior surface of said contact pin.

4. A switch chamber for a vacuum switch as defined in claim 1, wherein said terminating cover is fastened to said ceramic tube and said contact pin by means of solder connections.

5. A switch chamber for a vacuum switch as defined in claim 1, wherein said terminating cover is fastened to said ceramic tube and said contact pin by means of welded connections.

6. A switch chamber for a vacuum switch as defined in claim 1, and further comprising a damping buffer disposed adjacent the end face of said ceramic tube and an elastic support ring disposed at an end of said housing remote from said end face, said damping buffer and said support ring limiting inherent movement of said housing.

7. A switch chamber for a vacuum switch as defined in claim 6, and further comprising a sleeve carrying said movable contact and a fixed supporting member for supporting said sleeve, and wherein said support ring is disposed between said sleeve and said fixed supporting member, and said damping buffer cooperates with the end face of said ceramic tube.

8. In a switch chamber for a vacuum switch, including: a housing having at least one insulating tube with an end face and an axial axis; a contact pin having an exterior surface and arranged for supporting the switch chamber; a stationary contact held by the contact pin within the housing and having a frontal face; a movable contact contacting the frontal face of the stationary contact in the on-position of the vacuum switch under the force of a contact spring; sealing means including a bellows for connecting the movable contact with the housing in a vacuum-tight manner; a terminating cover connected to the insulating tube and to the contact pin in a vacuum-tight manner and transferring to the housing impact forces generated when the vacuum switch is switched on, the improvement wherein:

said insulating tube comprises a ceramic tube; and said terminating cover has a corrugated shape including at least one full corrugation and having an outer cut edge fastened to the end face of said ceramic tube and an inner cut edge fastened to the exterior surface of said contact pin; and wherein said switch chamber further includes a damping buffer disposed adjacent the end face of said ceramic tube and an elastic support ring disposed at an end of said housing remote from said end face, said damping buffer and said support ring limiting inherent movement of said housing.

9. A switch chamber for a vacuum switch as defined in claim 8, wherein the outer edge and the inner edge of said terminating cover are arranged at approximately a right angle to the end face of said ceramic tube and the exterior surface of said contact pin, respectively.

10. A switch chamber for a vacuum switch as defined in claim 8, wherein said terminating cover has a center line which is at least 1.5 times longer than the distance between where the outer edge of said terminating cover is fastened to the end face of said ceramic tube and where the inner edge of said terminating cover is fastened to the exterior surface of said contact pin.

11. A switch chamber for a vacuum switch as defined in claim 8, wherein said terminating cover comprises chromium-nickel steel having a wall thickness of no more than 1 mm.

12. A switch chamber for a vacuum switch as defined in claim 8, wherein said terminating cover is fastened to said ceramic tube and said contact pin by means of solder connections.

13. A switch chamber for a vacuum switch as defined in claim 8, wherein said terminating cover is fastened to said ceramic tube and said contact pin by means of welded connections.

14. A switch chamber for a vacuum switch as defined in claim 13, and further comprising a sleeve carrying said movable contact and a fixed supporting member for supporting said sleeve, and wherein said support ring is disposed between said sleeve and said fixed supporting member, and said damping buffer cooperates with the end face of said ceramic tube.

* * * * *